United States Patent [19]

Matsumoto

[11] 4,413,355

[45] Nov. 1, 1983

[54] ROTARY ANODE TYPE X-RAY TUBE

[75] Inventor: Toshio Matsumoto, Mobara, Japan

[73] Assignee: Hitachi, Ltd., Tokyo, Japan

[21] Appl. No.: 234,010

[22] Filed: Feb. 12, 1981

[30] Foreign Application Priority Data

Mar. 26, 1980 [JP] Japan ..... 55-37433

[51] Int. Cl.[3] ..... H01J 35/04

[52] U.S. Cl. ..... 378/127; 378/132; 378/144

[58] Field of Search ..... 378/127, 132, 144, 125

[56] References Cited

U.S. PATENT DOCUMENTS 2,081,789 5/1937 Bouwers ..... 378/127

4,097,759 6/1978 Furbee et al. ..... 378/144 X

*Primary Examiner*—Palmer C. Demeo

*Assistant Examiner*—Sandra L. O'Shea

*Attorney, Agent, or Firm*—Charles E. Pfund

[57] ABSTRACT

A rotary anode type X-ray tube has an enclosure, a target rotatably supported within the enclosure and serving as a source of X-ray generation, a cylindrical rotor connected to the target, for rotating the target by the action of rotating magnetic field produced by a winding provided around the enclosure, a rotary shaft on the central axis of the rotor for rotation of the target, and a stationary cylindrical housing concentric with the rotor interposed between the rotor and the rotary shaft, for supporting the rotary shaft through rolling bearings. In this type of X-ray tube, means is interposed between the rotor and the rotary shaft, for reducing the difference of temperature between the stationary cylindrical housing and the rotor.

8 Claims, 7 Drawing Figures

ROTARY ANODE TYPE X-RAY TUBE

BACKGROUND OF THE INVENTION

This invention relates to a rotary anode type X-ray tube and more particularly to an improvement of the X-ray tube wherein the difference of temperature between the inner and outer rings of the roller bearing which supports the rotary shaft for rotation of the target is reduced, thereby assuring prolongation of lifetime and reduction of noise.

The target of the rotary anode type X-ray tube is heated to a very high temperature due to the impingement of high speed electron beams. Typically, the target is connected to a cylindrical rotor and rotated thereby. The rotary shaft for rotation of this target also served as a central rotary shaft of the rotor and is rotatably mounted, by way of roller bearings, on a stationary cylindrical housing concentrically inserted in the cylindrical rotor.

The diameter of a connector shaft between the target and the rotor is made as small as possible so as to minimize heat transfer. However, a large amount of heat is transferred to the rotor, and the rotary shaft and rotor are still heated to a high temperature. On the other hand, the amount of heat transferred from the rotary shaft to the housing is small because of the interposition of the roller bearing, thereby maintaining the housing at an extremely low temperature relative to the rotary shaft and rotor in a conventional X-ray tube of rotary anode type. Since the housing is at a lower temperature relative to the rotary shaft and rotor, the temperature of the inner ring of the roller bearing which is in direct contact with the rotary shaft is higher than that of the outer ring of the roller bearing which is in contact with the housing by about 250° C. for example. In consideration of the difference of thermal expansion due to the difference of temperature during operation, the roller bearing needs to have a clearance of about 60 microns when the X-ray tube is not operated or at the beginning of the operation at which the inner and outer rings are at the same temperature. It is known that a large clearance in the bearing for supporting the rotary shaft rotating at so a high speed as in the rotary anode type X-ray tube causes not only vibration and noise, but considerable reduction of service life of the bearing due to the material fatigue.

SUMMARY OF THE INVENTION

Accordingly, it is an object of the present invention to provide an X-ray tube of rotary anode type which can reduce the difference of temperature between the inner and outer rings of the roller bearing and consequently operable with a smaller clearance in the bearing, thereby permitting a long life of the bearing and thus a long service life of the tube as a whole.

In order to achieve the above object, according to the invention, in a rotary anode type X-ray tube having an enclosure, a target rotatably supported within the enclosure and serving as a source of X-ray generation, a cylindrical rotor connected to the target, for rotating the target by the action of rotating magnetic field produced by a winding provided around the enclosure, a rotary shaft on the central axis of the rotor for rotation of the target, and a stationary cylindrical housing concentric with the rotor interposed between the rotor and the rotary shaft, for supporting the rotary shaft through roller bearings, the X-ray tube comprises means interposed between the rotor and the rotary shaft, for reducing the difference of temperature between the stationary cylindrical housing and the rotor.

In a preferred embodiment of the invention, the reducing means includes in combination blackening surface treatment films respectively formed on an inner peripheral surface of the stationary housing, inner and outer peripheral surfaces of a sleeve which is mounted on the rotary shaft for supporting the bearings, and the surface of the rotary shaft.

In another embodiment, the reducing means includes in combination blackening surface treatment films respectively formed on an inner peripheral surface of the rotor and an outer peripheral surface of the stationary housing.

Since blackening surface treatment, on the one hand, enhances efficiency of heat radiation and on the other hand enhances efficiency of heat absorption, the amount of heat transferred by heat radiation from the rotary shaft and rotor, which are heated to a high temperature by the heat conduction from the target to the housing is increased during operation of the tube so that the temperature of the housing is raised and the difference of temperature between the inner and outer rings of the roller bearing is reduced. The clearance in the roller bearing is preferably about 1 to 3 microns and the difference of temperature between the inner and outer rings is 50° C. or less, preferably 10° C. or less.

DESCRIPTION OF THE PREFERRED EMBODIMENTS

Figure 1:
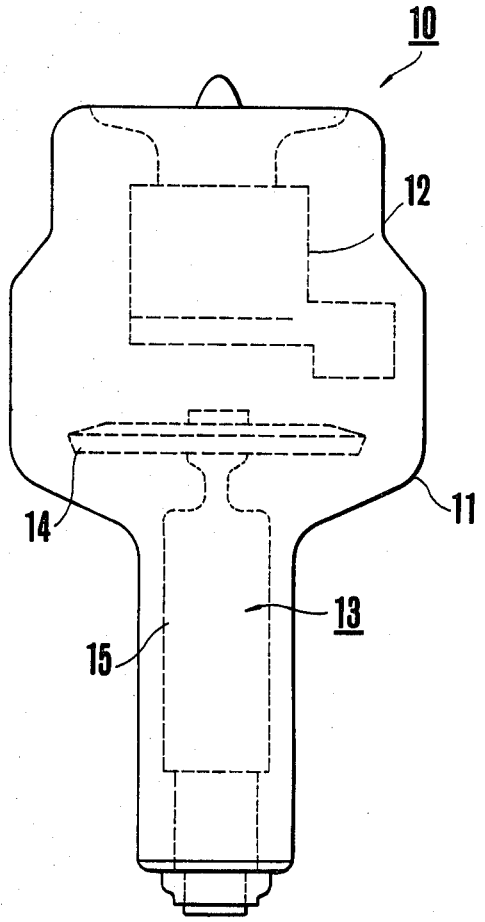
FIG. 1 is a schematic view showing the overall construction of a rotary anode type X-ray tube according to the invention.

Referring now to FIG. 1, a rotary anode type X-ray tube 10 has an enclosure 11 such as a glass envelope. The interior of the enclosure is evacuated to a suitable vacuum degree. An anode 13 opposes a cathode 12 on the longitudinal axis of the enclosure 11. High speed beams of electron from the cathode 12 bombard a target 14 of the anode 13, creating a source of X-ray on the target. X-rays emanated from the source transmit through a window (not shown) of the enclosure 11 and radiate exteriorly of the enclosure. The target 14 is coupled with a rotor 15 which is rotated by the action of rotating magnetic field produced by a winding (not shown) wound about the enclosure, and is rotated during operation of the X-ray tube to prevent local temperature rise in the target.

Figure 2A:
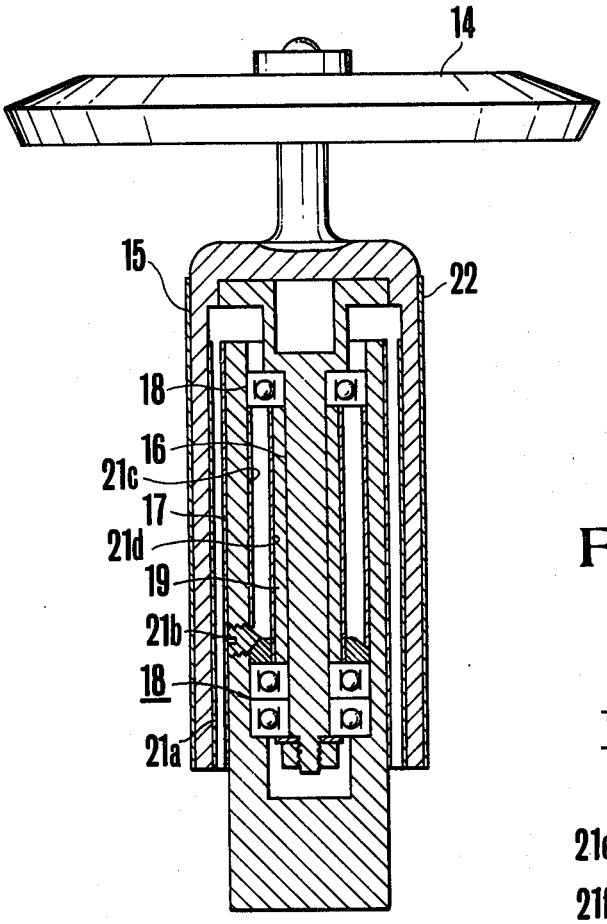
FIG. 2A is a fragmentary sectional view showing the anode provided with temperature difference reducing means according to the invention.
Figure 2B:
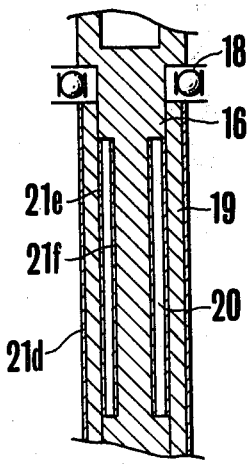
FIG. 2B is a fragmentary sectional view showing details of a rotary shaft for rotation of the target shown in FIG. 2A.

As shown in FIG. 2A, the rotor 15 of the anode 13 is cylindrical and a rotary shaft 16 for rotation of the target 14 is provided coaxially with the central axis of the rotor. Concentrically interposed between the rotor 15 and the rotary shaft 16 is a stationary cylindrical housing 17 fixed to the enclosure 11. The rotary shaft 16 integral with the rotor 15 is rotatably supported by the stationary housing 17 through roller bearings 18. A sleeve 19 mounted on the rotary shaft 16 abuts, at its opposite ends, against the bearings 18 to hold them in place. Actually, as shown in FIG. 2B, the diameter of a portion of the rotary shaft which is surrounded by the sleeve 19 is reduced to avoid deformation of the rotary shaft 16 which would occur at a high speed rotation, leaving behind a gap 20 between the rotary shaft and the sleeve.

Figure 3:
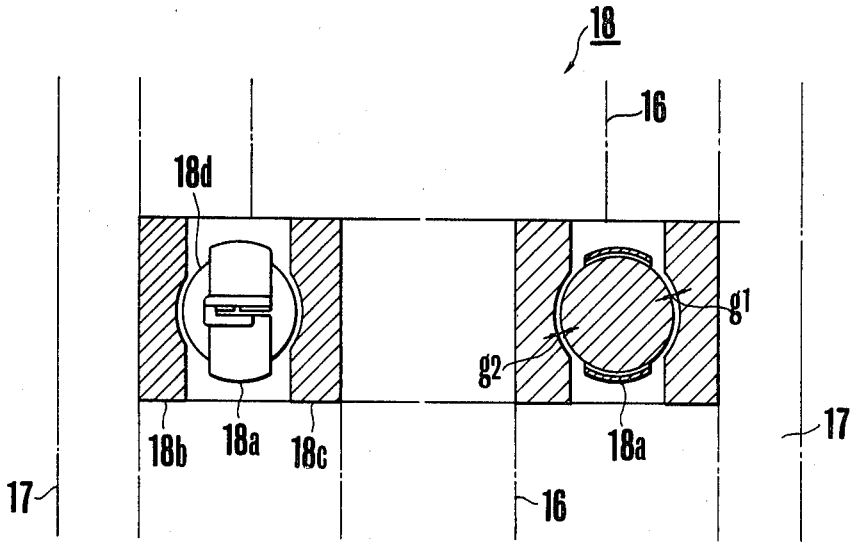
FIG. 3 is a fragmentary sectional view showing details of a roller bearing shown in FIG. 2A.
Figure 4:
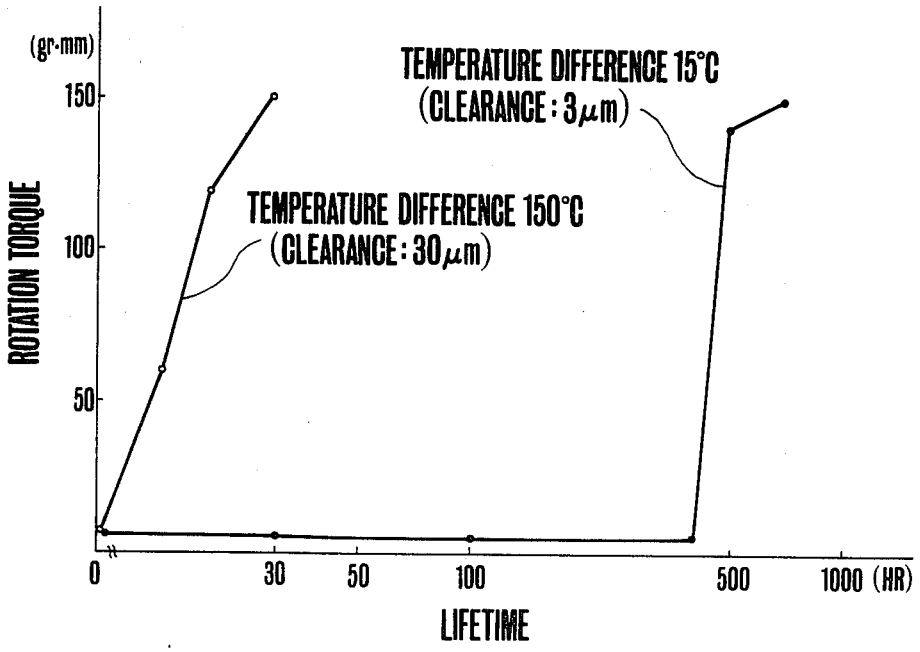
FIG. 4 is a graphical representation showing rotation torque/lifetime relationship having dependency on the difference of temperature between inner and outer rings of the roller bearing.

The roller bearing 18, which may be an ordinary roller bearing, has a container 18*a*, an outer ring 18*b*, an inner ring 18*c* and roller balls 18*d*, as shown in FIG. 3. Since the housing 17 is at a lower temperature relative to the rotary shaft 16 and rotor 15, the temperature of the inner ring 18*c* of the roller bearing which is in direct contact with the rotary shaft 16 is higher than that of the outer ring 18*b* of the roller bearing which is in contact with the housing 17 by about 250° C., for example. In consideration of the difference of thermal expansion due to the difference of temperature during operation, the roller bearing needs to have large clearances g1 and g2 between the roller ball 18*d* and the inner ring 18*c* as well as between the roller ball 18*d* and the outer ring 18*b*, when the X-ray tube is not operated or at the beginning of the operation at which the inner and outer rings are at the same temperature. The sum of g1 and g2 amounts up to about 60 microns. When the X-ray tube is operated with the temperature difference being about 150° C. and the clearance being 30 microns, its life is considerably reduced as shown in FIG. 4.

Returning to FIGS. 2A and 2B, according to the invention, the temperature difference reduction means is provided between the rotor 15 and the rotary shaft 16, for reducing the aforementioned temperature difference. This reduction means comprises blackening surface treatment films 21*a* to 21*f* formed on an inner peripheral surface of the rotor 15, outer and inner peripheral surfaces of the housing 17, outer and inner peripheral surfaces of the sleeve 19, and the surface of the rotary shaft 16. It will be appreciated that a blackening surface treatment film 22 also formed on an outer peripheral surface of the rotor 15 is a film which has been conventionally provided for enhancing heat radiation to outside and it does not contribute to elongation of life of the rotary elements.

It is not always necessary to provide all the blackening surface treatment films 21*a* to 21*f*. Otherwise, good results of temperature difference reduction was obtained with the films 21*a* and 21*b* in combination. Also, substantial temperature difference reduction resulted from the films 21*c*, 21*d*, 21*e* and 21*f* in combination. As the blackening surface treatment film, a 1 to 5 micron thickness plating film of blackened chromium may preferably be used.

Figure 5:
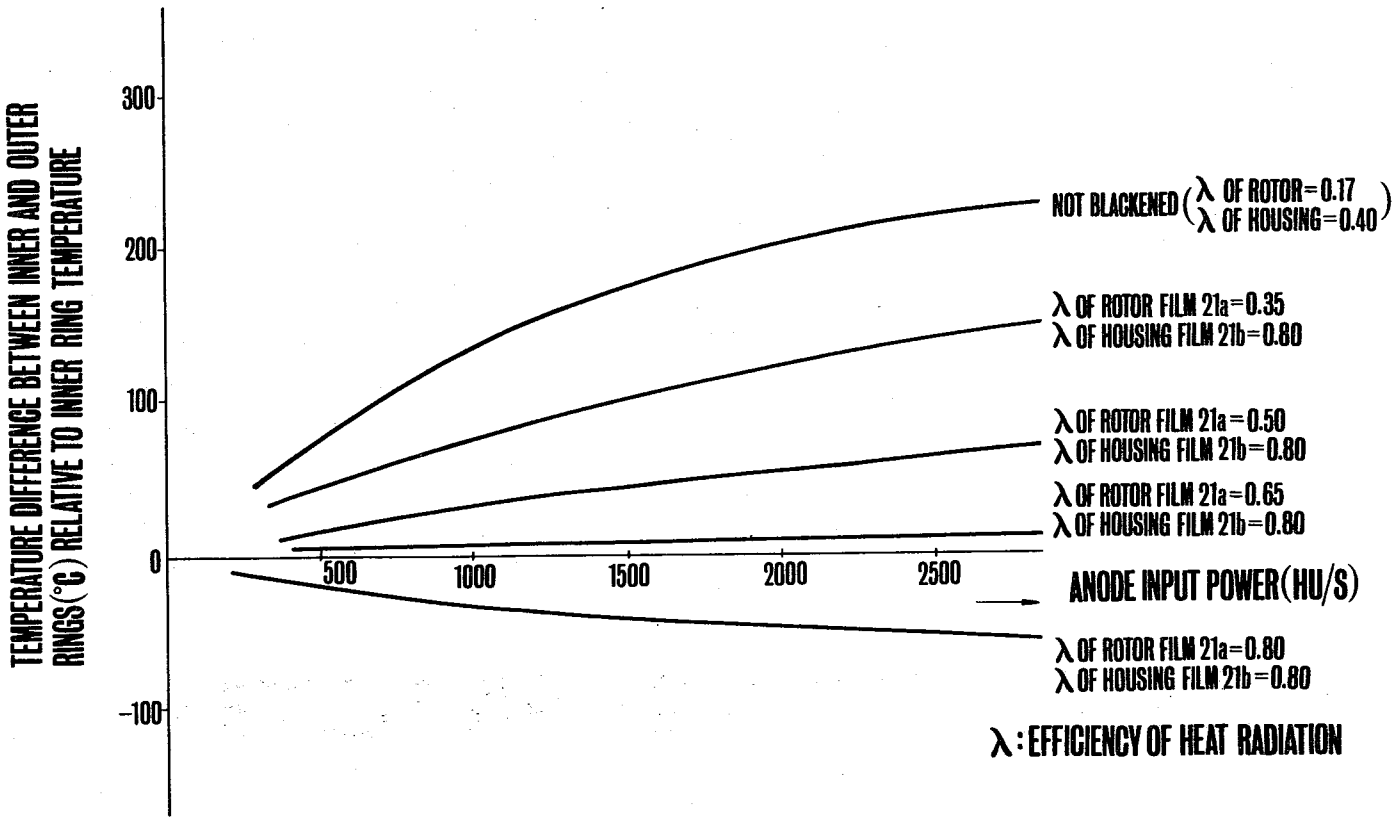
FIG. 5 is a graph showing the affect of the blackening surface treatment according to the present invention on the difference of temperature between the inner and outer rings of the bearing.

Measurement results are shown at solid line curves in FIG. 5 for various combinations of heat radiation efficiency λ of the film 21*a* on the rotor inner surface and the film 21*b* on the housing outer surface, where abscissa represents anode input power in terms of HU/s (1 HU/s=0.71 Watts) and ordinate temperature difference (°C.) of the outer ring relative to the inner ring. It can be seen from this figure that the difference of temperature between the inner and outer rings is made very small when λ is 0.65 for the film 21*a* and 0.80 for film 21*b*. When the difference of temperature between the inner and outer rings is maintained within 15° C. at 3 micron clearance in this way, the service life of the X-ray tube can be extended by almost 10 times as shown in FIG. 4.

It is to be noted that the bare surface of a copper rotor has a heat radiation efficiency of about 0.17, and the bare surface of a housing made of ferrous material has a heat radiation efficiency of about 0.40.

Figure 6:
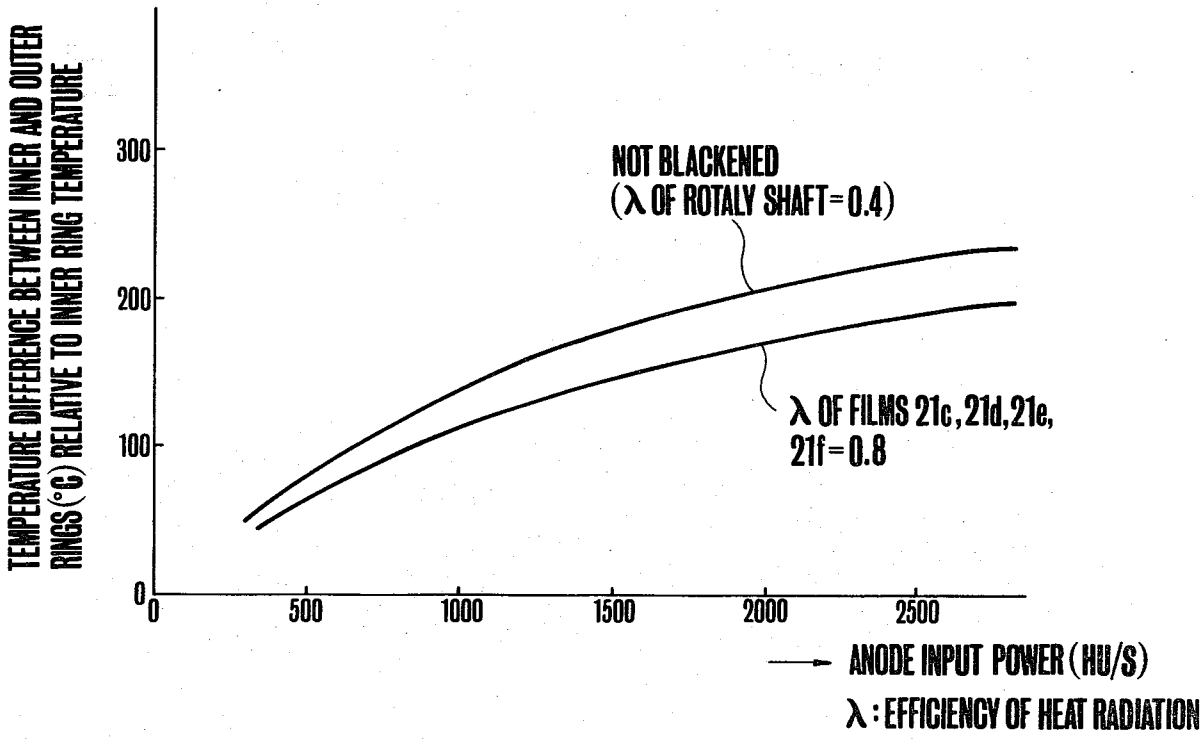
FIG. 6 is a graph showing effects similar to FIG. 5.

FIG. 6 shows effects brought about by the provision of the films 21*c*, 21*d*, 21*e* and 21*f* in combination wherein each film has a heat radiation efficiency of 0.8.

As described above, the present invention provides an X-ray tube of the rotary anode type whose service life is improved significantly by very simple means.

What is claimed is:

1. A rotary anode type X-ray tube having an enclosure, a target rotatably supported within the enclosure and serving as a source of X-ray generation, a cylindrical rotor connected to the target, for rotating the target by the action of rotating magnetic field produced by a winding provided around the enclosure, a rotary shaft on the central axis of the rotor for rotation of the target, and a stationary cylindrical housing concentric with the rotor interposed between the rotor and rotary shaft, for supporting the rotary shaft through rolling bearing means having inner and outer races, said X-ray tube having means interposed between said rotor and said rotary shaft for reducing the difference of temperature between the inner and outer races of said rolling bearing means to 50° C. or less comprising blackening surface treatment films formed on the opposed surfaces of said shaft mounting said inner race and the inner surface of said stationary cylindrical housing supporting said outer race.

2. An X-ray tube as recited in claim 1, wherein said reducing means further includes in combination blackening surface treatment films respectively formed on an inner peripheral surface of said rotor and an outer peripheral surface of said stationary housing.

3. An X-ray tube as recited in claim 1, wherein said rotary shaft has a reduced diameter surface less than the inner diameter of said bearing for a substantial portion of its length to form a shoulder for seating one of said bearings, said rolling bearings supported by opposite ends of said sleeve mounted on said rotary shaft, and wherein said reducing means includes in combination blackening surface treatment films respectively formed on an inner peripheral surface of said stationary housing, inner and outer peripheral surfaces of said sleeve, and the reduced diameter surface of said rotary shaft.

4. An X-ray tube as recited in claim 1 2 or 3, wherein said blackening surface treatment film comprises a plating film of blackened chromium.

5. An X-ray tube as recited in claim 4, wherein the plating film has a thickness of from 1 to 5 microns.

6. An X-ray tube as recited in claim 2 or 3 which further comprises a blackening surface treatment film formed on an outer peripheral surface of said rotor.

7. The method of maintaining temperature differential between the races of rolling bearings used to support the rotary shaft of the anode in a rotary anode X-ray tube to be substantially below 100° C. comprising the step of coated opposed surfaces of the rotor and the concentric stationary support for the outer race of said bearings with a film having heat radiation efficiency of 50% or greater.

8. The method according to claim 7 wherein said film on the inner surface of said rotor has a heat radiation efficiency of 65% and said film opposed thereto on the center surface of said stationary support has a heat radiation efficiency of 80% to make said temperature differential approximately 15° C.

* * * * *